US005765581A

United States Patent [19]

Badger et al.

[11] Patent Number: 5,765,581

[45] Date of Patent: Jun. 16, 1998

[54] VARIABLE GEOMETRY SPRAY NOZZLE

[75] Inventors: Gordon George Badger; Paul Stephen Hood, both of Auckland, New Zealand

[73] Assignee: Fisher & Paykel Limited, Auckland, New Zealand

[21] Appl. No.: 726,379

[22] Filed: Oct. 4, 1996

Related U.S. Application Data

[63] Continuation of Ser. No. 684,891, Jul. 25, 1996.

[51] Int. Cl.[6] ..... B08B 3/02

[52] U.S. Cl. ..... 134/198; 134/201; 239/66; 239/533.13; 239/551; 68/207; 68/23.5

[58] Field of Search ..... 68/207, 23.5; 134/198, 134/201; 239/438, 556, 443, 560, 444, 563, 447, 66, 76, 533.13, 533.1, 570, 551; 137/627, 625.12, 625.11, 869, 881, 883, 878, 516.27, 625.33, 118.06, 535, 540, 543.21; 251/210

[56] References Cited

U.S. PATENT DOCUMENTS

| | | | |
|---|---|---|---|
| 2,994,482 | 8/1961 | Valois et al. | 239/563 |
| 3,559,678 | 2/1971 | Donner | 137/535 |
| 3,565,347 | 2/1971 | Denninger et al. | 239/556 |
| 3,656,694 | 4/1972 | Kirschke | 239/533.1 |
| 3,784,112 | 1/1974 | Collignon | 239/563 |
| 3,874,597 | 4/1975 | Stephens et al. | 239/563 |
| 3,912,173 | 10/1975 | Robichaux | 239/560 |
| 4,361,280 | 11/1982 | Rosenberg | 239/76 |
| 4,508,274 | 4/1985 | Eichfeld et al. | 239/563 |

*Primary Examiner*—Frankie L. Stinson

*Attorney, Agent, or Firm*—Trexler, Bushnell, Giangiorgi & Blackstone, ltd.

[57] ABSTRACT

A laundry machine which has a spray head for spraying liquid into laundry machines into a defined target area. The spray head includes a tubular body with first and second groups of spray nozzles in the body wall located at different longitudinal spacings from the inlet. A pressure operated valve is mounted in the body which in a closed position enables low pressure liquid entering the spray head to exit from the first group of spay nozzles and in an open position enables higher pressure liquid to exit from both the first and second groups of spray nozzles.

4 Claims, 1 Drawing Sheet

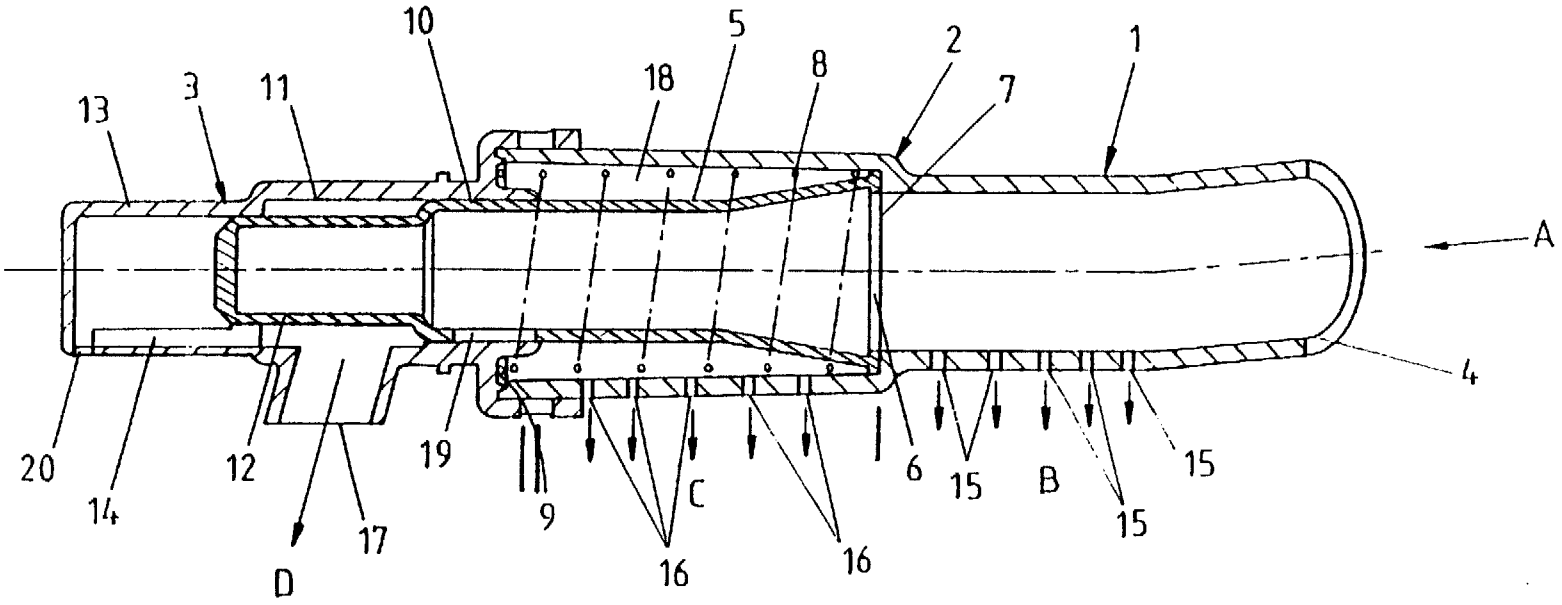
A
4
1
2
7
8
5
18
10
11
3
13
20
14
12
17
D
19
9
16
C
16
6
15
B
15
15

VARIABLE GEOMETRY SPRAY NOZZLE

This is a continuation of copending application Ser. No. 08/684,891, filed Jul. 25, 1996, now pending.

FIELD OF THE INVENTION

This invention relates to laundry machines and in particular to a spray head for spraying liquid into laundry machines.

PRIOR ART

To reduce the water consumed in a full wash cycle and in particular during the rinse cycles it is known to achieve adequate wetting of the clothes load by the use of an appropriately directed spray. A problem arises, however, in that conventional spray heads achieve a desired spray pattern in a desired target area only over a small water pressure range. Since laundry machines are inevitably used at sites having widely varying mains water supply pressures and, since mains pressure may vary at any given site, water may be needlessly wasted with a high pressure supply and be improperly dispersed with a low pressure supply.

Alternatively, in laundry machines having mixing chambers for the hot and cold water supply feeds, a spray head designed for a single "average" flow rate may produce back pressure problems with high flow rates when both hot and cold valves are open.

SUMMARY OF THE INVENTION

It is an object of the present invention to provide a spray head and a laundry machine incorporating a spray head which go some way towards overcoming the above mentioned disadvantages.

Accordingly in one aspect the invention consists in a spray head for a liquid supply line which directs liquid into a defined target area substantially independent of the pressure of the liquid in the line comprising:

a tubular body having an inlet adapted to connect to said supply line, at least first and second groups of spray nozzles in the body wall each located at different longitudinal spacings from said inlet, a valve mounted within said body and movable between a closed position where in use liquid entering said inlet can exit from said first group of spray nozzles but is prevented from exiting from said second group of nozzles and a first open position where in use liquid entering said inlet can exit from both the first and second groups of spray nozzles, and valve bias means which bias said valve in the closed position, bias force being set such that the force exerted on said valve by said liquid will cause it to open when the liquid pressure exceeds a first predetermined value.

In a further aspect the invention consists in a laundry machine having a wash cycle and a rinse cycle which machine includes a watertight tub, a spin basket for holding a load of clothes and rotatably mounted within said tub, and spray means for spraying liquid into said spin basket at least during said rinse cycle, wherein said spray means comprise:

a body having an inlet adapted to connect to a liquid supply line, at least first and second groups of spray nozzles in the body wall each located at different longitudinal spacings from said inlet, a valve mounted within said body and movable between a closed position where in use liquid entering said inlet can exit from said first group of spray nozzles but is prevented from exiting from said second group of nozzles and a first open position where in use liquid entering said inlet can exit from both the first and second groups of spray nozzles, and valve bias means which bias said valve in the closed position, the bias force being set such that the force exerted on said valve by said liquid will cause it to open when the liquid pressure exceeds a first predetermined value, and said spray means located and oriented such that liquid sprayed from both said first and second groups of nozzles is directed into a defined target area within said spin basket.

BRIEF DESCRIPTION OF THE DRAWING

The preferred form of the invention will now be described with reference to the accompanying drawing which shows a diagrammatic longitudinal cross section of the spray head of the present invention.

DETAILED DESCRIPTION OF THE PREFERRED EMBODIMENT

The spray head 1 in the preferred form is formed by a body section 2 to which is attached an end cap 3. Both components are hollow and body 2 has a tubular inlet 4 for connection to the laundry machine water supply. The body section is preferably moulded from polypropylene, while the end cap is preferably moulded from acetal. Other plastics could be used.

Within the assembled body 2 and end cap 3 resides a valve 5 which is hollow and can slide longitudinally within end cap 3. In the drawing the valve is shown in the closed position with its open annular flange 6 sealed against shoulder 7 formed in the interior wall of body 2. Valve 5 may slide to an infinitely variable open position by (in the orientation shown in the drawing) moving to the left. A large diameter aperture 19 is located in the side wall of the valve for a purpose to be described later.

Valve 5 is fitted with a compression spring 8 which abuts against the rear of flange 6 and at the opposite end abuts against surface 9 of the end cap. Spring 8 thus biases valve 5 in the closed position. The wider diameter portion 10 of valve 5 is a sliding fit within larger diameter bore 1 in the end cap. The smaller diameter section of the valve 12 is a sliding fit within the smaller diameter bore 13 in the end cap. A spline (not shown) on section 12 engages with a keyway 14 to ensure correct orientation of the valve within the body.

A first set of spray nozzles 15 are formed in the wall of body 2 on the inlet side of valve 5. Nozzles 15 make up a substantially rectangular pattern of apertures although only 5 co-linear apertures are shown in the drawing. A second set of spray nozzles 16 are formed in the wider and tapered section of body 1 on the downstream side of valve 5. Apertures 16 are also arranged in a rectangular pattern lying on the same centreline as nozzles 15.

A single large diameter nozzle 17 is provided in end cap 3 directed forwardly of the other nozzle groups taking into account it is downstream of the others and that the position of the spin basket will have advanced by the time water from nozzle 17 strikes the clothes load.

Nozzles 15 and 16 are sized and grouped so as to provide, when water is passed through either or both sets, a spray of desired directivity which when the spray head is properly mounted within the laundry machine ensures water is sprayed into a desired target area within the machine.

The function of the spray head will now be described with reference to the laundry machine rinse cycles. Water enters inlet 4 in the direction shown by arrow A from a controlled solenoid valve. If the water pressure is less than a first predetermined value, the incoming water will exert insufficient force against valve 5 to cause it to open against the restoring force applied by spring 8. Incoming water will have filled the narrower diameter portion of body 1 and filled the hollow valve 5. The spray head will emit a spray B through nozzles 15 only. Spray B is adequate for rinse purposes.

For water pressures exceeding the first predetermined value, the force exerted by the water against valve 5 will cause it to open against the restoring force of spring 8 and allow water to enter the wider diameter portion of body 2 to fill space 18 and thereby exit through spray nozzles 16. Spray C emitted by nozzles 16 is essentially coherent with spray B as the two groups of spray nozzles are only a few centimetres apart..

After a second predetermined value of water pressure has been exceeded valve 5 will have moved open to such an extent that valve aperture 19 will at least partly overlap nozzle 17 to allow water within the hollow valve to discharge through nozzle 17. At even higher pressures, aperture 19 will be moved into full registration with nozzle 17 to allow maximum discharge for over pressure conditions. The opening 20 in end cap 3 ensures the volume behind the valve is maintained at atmospheric pressure and thus does not impede valve movement.

The spring constant may be varied to suit grossly differing supply pressures by either altering the spring length or changing the gauge of the steel wire forming the spring.

The operation of the spray head may be viewed as one where back pressure build up is prevented by the head progressively allowing increased discharge as incoming flow rate increases beyond the capacity of each set of nozzles.

It will be appreciated from the above that a spray head is provided which produces a defined and known spray pattern over a variety of feed water pressures and without back pressure problems.

We claim:

1. A spray head for a liquid supply line which directs liquid into a defined target area substantially independent of the pressure of the liquid in the line comprising:

a tubular body having an inlet adapted to connect to said supply line, at least first and second spray nozzle means in the body wall each located at different longitudinal spacings from said inlet, a valve mounted with said body and longitudinally movable between a closed position where in use liquid entering said inlet is permitted to exit only from said first spray nozzle means and a first open position where in use liquid entering said inlet can exit from both the first and second spray nozzle means, and valve bias means which bias said valve in the closed position, bias force being set such that the force exerted on said valve by said liquid will cause it to open when the liquid pressure exceeds a first predetermined value.

2. A spray head for a liquid supply line which directs liquid into a defined target area substantially independent of the pressure of the liquid in the line comprising:

a tubular body having an inlet adapted to connect to said supply line, said body being provided with an excess pressure nozzle, at least first and second spray nozzle means in the body wall each located at different longitudinal spacings from said inlet, a valve mounted with said body and longitudinally movable between a closed position where in use liquid entering said inlet is permitted to exit only from said first spray nozzle means and a first open position where in use liquid entering said inlet can exit from both the first and second spray nozzle means, and valve bias means which bias said valve in the closed position, bias force being set such that the force exerted on said valve by said liquid will cause it to open when the liquid pressure exceeds a first predetermined value, and said valve being further movable longitudinally to a second open position to allow a liquid entering said inlet to exit through said excess pressure nozzle as well as said first and second nozzle means when the pressure of said liquid exceeds a second predetermined value.

3. A laundry machine having a wash cycle and a rinse cycle which machine includes a watertight tub, a spin basket for holding a load of clothes and rotatably mounted within said tub, and spray means for spraying liquid into said spin basket at least during said rinse cycle, wherein said spray means comprise:

a body having an inlet adapted to connect to a liquid supply line, at least first and second spray nozzle means in the body wall each located different longitudinal spacings from said inlet, a valve mounted within said body and longitudinally movable between a closed position where in use liquid entering said inlet is permitted to exit only from said first spray nozzle means and a first open position where in use liquid entering said inlet can exit from both the first and second spray nozzle means, and valve bias means which bias said valve in the closed position, the bias force being set such that the force exerted on said valve by said liquid will cause it to open when the liquid pressure exceeds a first predetermined value, and said spray means located and oriented such that liquid sprayed from both said first and second nozzle means is directed into a defined target area within said spin basket.

4. A laundry machine having a wash cycle and a rinse cycle which machine includes a watertight tub, a spin basket for holding a load of clothes and rotatable mounted within said tub, and spray means for spraying liquid into said spin basket at least during said rinse cycle, wherein said spray means comprise:

a body having an inlet adapted to connect to a liquid supply line, said body being provided with an excess pressure nozzle, at least first and second spray nozzle means in the body wall each located different longitudinal spacings from said inlet, a valve mounted within said body and longitudinally movable between a closed position where in use liquid entering said inlet is permitted to exit only from said first spray nozzle means and a first open position where in use liquid entering said inlet can exit from both the first and second spray nozzle means, valve bias means which bias said valve in the closed position, the bias force being set such that the force exerted on said valve by said liquid will cause it to open when the liquid pressure exceeds a first predetermined value, and said spray means located and oriented such that liquid sprayed from both said first and second nozzle means is directed into a defined target area within said spin basket, and said valve being further movable longitudinally to a second open position to allow liquid entering said inlet to exit through said excess pressure nozzle as well as said first and second nozzle means when the pressure of said liquid exceeds a second predetermined value.

* * * * *